US008539937B2

(12) United States Patent
Kobayashi

(10) Patent No.: US 8,539,937 B2
(45) Date of Patent: Sep. 24, 2013

(54) FUEL SUPPLYING APPARATUS FOR INTERNAL COMBUSTION ENGINE

(75) Inventor: Takao Kobayashi, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 316 days.

(21) Appl. No.: 13/158,928

(22) Filed: Jun. 13, 2011

(65) Prior Publication Data

US 2011/0303196 A1 Dec. 15, 2011

(30) Foreign Application Priority Data

Jun. 14, 2010 (JP) ..... 2010-135283

(51) Int. Cl.
*F02B 25/06* (2006.01)
*F01M 11/08* (2006.01)

(52) U.S. Cl.
USPC ..... 123/572; 123/573; 123/198 DA

(58) Field of Classification Search
USPC ..... 123/495, 511, 437, 73 PP, 572–574, 123/198 DA
See application file for complete search history.

(56) References Cited

U.S. PATENT DOCUMENTS

| | | | | |
|---|---|---|---|---|
| 3,665,906 | A * | 5/1972 | De Palma | 123/519 |
| 3,859,967 | A * | 1/1975 | Turner et al. | 123/73 A |
| 3,929,111 | A * | 12/1975 | Turner et al. | 123/73 R |
| 3,952,719 | A | 4/1976 | Fenton et al. | |
| 4,257,383 | A * | 3/1981 | Boswell | 123/572 |
| 6,021,766 | A * | 2/2000 | Maeda et al. | 123/573 |
| 6,196,206 | B1 * | 3/2001 | Bedkowski | 123/572 |
| 6,460,525 | B1 * | 10/2002 | Shureb | 123/572 |
| 6,694,957 | B2 * | 2/2004 | Schueler et al. | 123/572 |
| 6,832,603 | B2 * | 12/2004 | Knollmayr | 123/572 |
| 7,383,829 | B2 * | 6/2008 | Shieh | 123/572 |
| 7,775,194 | B2 * | 8/2010 | Kono et al. | 123/517 |
| 8,042,529 | B2 * | 10/2011 | Meinig et al. | 123/572 |

FOREIGN PATENT DOCUMENTS

| | | |
|---|---|---|
| JP | 11-315769 A | 11/1999 |
| JP | 4310294 B2 | 8/2009 |

OTHER PUBLICATIONS

Chinese Office Action dated Feb. 18, 2013, issued in corresponding Chinese Patent Application No. 201110155668.X (5 pages).

* cited by examiner

*Primary Examiner* — Thomas Moulis
(74) *Attorney, Agent, or Firm* — Westerman, Hattori, Daniels & Adrian, LLP

(57) ABSTRACT

A fuel supplying apparatus is disclosed that suppresses intrusion of oil mist into a negative pressure introducing inlet of an automatic cock and that, thereby, improves the degree of freedom of disposition. The negative pressure introducing inlet of the automatic cock is connected to a crankcase through a negative pressure communication path. The automatic cock is opened by a negative pressure generated in the crankcase and, thereby, a fuel supply path is opened that is for supplying fuel from a fuel tank to an internal combustion engine. The negative pressure communication path communicates with the air cleaner through a purge path that branches from the negative pressure communication path at a halfway point of the negative pressure communication path. The point at which the purge path branches from the negative pressure communication path is set to be at the lowest position of the negative pressure communication path to be able to collect the oil mist intruding from the crankcase.

3 Claims, 6 Drawing Sheets

FUEL SUPPLYING APPARATUS FOR INTERNAL COMBUSTION ENGINE

FIELD OF THE INVENTION

The present invention relates generally to an apparatus for supplying fuel to an internal combustion engine and, more particularly, to a technique of opening a fuel supply path by using a negative pressure in a crankcase.

BACKGROUND OF THE INVENTION

Schemes of supplying fuel from a fuel tank to an intake system of an internal combustion engine includes a scheme of supplying fuel by using a fuel pump and a scheme of supplying fuel by using the gravity. According to the scheme of supplying fuel by using the gravity, a fuel tank is disposed above a carburetor and the fuel is supplied from the fuel tank to the carburetor. This scheme employs a relatively simple configuration and is often used.

According to the scheme of supplying fuel by using the gravity, an automatic cock is disposed in a fuel supply path to introduce the fuel from the fuel tank to the carburetor. The automatic cock is a valve that opens the fuel supply path by using a negative pressure in a crankcase. During the driving of the internal combustion engine, a negative pressure is generated in the crankcase associated with the reciprocating motion of a piston (more specifically, a large negative pressure and a micro positive pressure are alternately and repeatedly generated). The automatic cock is opened by this negative pressure and, thereby, the fuel in the fuel tank flows into the carburetor through the fuel supply path.

A common internal combustion engine rakes up a lubricating oil stored in the crankcase upward to splash the lubricating oil and, thereby, generates oil mist to lubricate a portion to be slid that is accommodated in the crankcase. This is not preferable because the oil mist adheres to parts in the automatic cock when the oil mist intrudes into the automatic cock.

In contrast, a fuel supplying apparatus that suppresses intrusion of the oil mist into a negative pressure introducing inlet of the automatic cock is known from, for example, Japanese Patent No. 4310294. In the known fuel supplying apparatus: a crankcase is connected to an intake system through a gas/liquid separating apparatus, a breather path, and a reed valve; and a branch outlet that branches from the breather path is connected to the negative pressure introducing inlet of the automatic cock.

When a positive pressure is generated in the crankcase, the reed valve is opened by the positive pressure. Oil mist and blowby gas produced in the crankcase are caused to circulate from the crankcase to the intake system and, thereby, are combusted in a combustion chamber. On the other hand, when a negative pressure is generated in the crankcase, the automatic cock is opened by this negative pressure. The fuel in the fuel tank is supplied to the carburetor through the fuel supply path.

The gas/liquid separating apparatus is positioned between the crankcase and the breather path, and separates from the air the oil mist produced in the crankcase. Therefore, the intrusion is suppressed of the oil mist into the negative pressure introducing inlet of the automatic cock through the breather path. In addition, the automatic cock is positioned immediately and exactly above the crankcase. Therefore, even if the oil mist intrudes into the negative pressure introducing inlet of the automatic cock, the oil mist tends to flow out to the breather path thereunder due to the gravity.

When the automatic cock is disposed immediately and exactly above the crankcase adjacent thereto, the thermal influence needs to be fully taken into consideration that is caused by the heat dissipation of the internal combustion engine. When the automatic cock is disposed above the crankcase far away therefrom to avoid receiving the thermal influence, the degree of freedom of disposing the fuel supplying apparatus is reduced and, therefore, this is not preferable. In addition, the fuel supplying apparatus employs the scheme of supplying the fuel by using the gravity and, therefore, the fuel tank is positioned above the automatic cock. Especially, for a configuration that has an internal combustion engine and a fuel supplying apparatus incorporated as one unit such as, for example, a small sound-proof engine-driven generator, the height of the unit as a whole is often limited. To suppress the total height, it is considered to make the fuel tank thin. However, this result in reducing the capacity of the fuel tank and, therefore, this is not an advisable solution.

SUMMARY OF THE INVENTION

It is therefore an object of the present invention to provide an apparatus that is capable of suppressing intrusion of oil mist into a negative pressure introducing inlet of an automatic cock, increasing the degree of freedom of disposition of a fuel supplying apparatus, and sufficiently securing the capacity of a fuel tank.

According to an aspect of the present invention, there is provided a fuel supplying apparatus for an internal combustion engine, which comprises: a crankcase of the internal combustion engine; a negative pressure introducing inlet of an automatic cock connected to the crankcase through a negative pressure communication path; and a fuel supplying path that is opened for supplying fuel from a fuel tank to the internal combustion engine, by opening the automatic cock through a negative pressure generated in the crankcase, wherein the negative pressure communication path communicates with an air cleaner through a purge path that branches from the negative pressure communication path at a halfway point of the negative pressure communication path, and a point at which the purge path branches from the negative pressure communication path is set to be at a lowest position of the negative pressure communication path so that oil mist that intrudes from the crankcase can be collected.

The apparatus uses a property that, during driving of the internal combustion engine, a pressure in the crankcase is usually lower than a pressure in the air cleaner. The pressure in the air cleaner is higher than the pressure in the crankcase.

The purge path branches from the negative pressure communication path at a halfway point of the negative pressure communication path. The negative pressure communication path communicates with the air cleaner through the purge path. Therefore, the air in the air cleaner flows from the purge path into the crankcase passing through the negative pressure communication path. The intrusion of the oil mist into the negative pressure communication path is able to be excluded by the air in the air cleaner. As a result, the intrusion is suppressed of the oil mist in the crankcase, into the negative pressure introducing inlet of the automatic cock passing through the negative pressure communication path.

In addition, according to the present invention, the point at which the purge path branches from the negative pressure communication path is set to be at the lowest position of the negative pressure communication path such that the point is able to collect the oil mist that intrudes from the crankcase. Even if the oil mist intrudes from the crankcase into the negative pressure communication path, the oil mist intruding gathers at the lowest position of the negative pressure communication path. Therefore, even when the automatic cock is not disposed above the crankcase, the intrusion is able to be suppressed of the oil mist into the negative pressure introducing inlet of the automatic cock. As above, the automatic cock does not need to be disposed above the crankcase and, therefore, the positions of the automatic cock and the fuel tank are able to arbitrarily be set at positions at which no thermal influence is received that is caused by the heat dissipation from the internal combustion engine. Therefore, the degree of freedom of disposition of the fuel tank and the fuel supplying apparatus is able to be increased.

Even when the height is limited for disposing the fuel tank, the capacity of the fuel tank is able to sufficiently be secured by disposing the fuel tank at a suitable position. For example, even when the internal combustion engine and the fuel supplying apparatus are incorporated as one unit and the height of the unit as a whole is limited, the capacity of the fuel tank is able to sufficiently be secured by suitably setting the position of the fuel tank.

Preferably, a point at which the purge path is connected to the air cleaner is positioned at a position that is lower than the point at which the purge path branches. Therefore, the oil mist gathering at the lowest position of the negative pressure communication path enters the air cleaner passing through the purge path due to the gravity. The oil mist entering the air cleaner is combusted in the combustion chamber. As a result, the intrusion of the oil mist into the negative pressure introducing inlet of the automatic cock can further be suppressed.

Desirably, the purge path has an air flow resistance increasing unit in the vicinity of the point at which the purge path branches, and the air flow resistance increasing unit is adapted to set air flow resistance of the purge path to be higher than air flow resistance of the negative pressure communication path. The pressure loss of the purge path as a whole is increased by increasing the air flow resistance of the purge path by the air flow resistance increasing unit as above. As a result, at the branching point, the pressure difference is able to be set to be an optimal value between the internal pressure of the negative pressure communication path and the internal pressure of the purge path. Because the pressure difference is suitable, the negative pressure state in the negative pressure communication path is not offset by the pressure of the air that flows from the purge path to the negative pressure communication path. The negative pressure in the negative pressure communication path is able to sufficiently be secured that acts to open the automatic cock and, therefore, the automatic cock is able to suitably be operated to open and close.

BRIEF DESCRIPTION OF THE DRAWINGS

A preferred embodiment of the present invention will be described in detail below, by way of example only, with reference to the accompanying drawings in which.

DETAILED DESCRIPTION OF THE PREFERRED EMBODIMENT

Figure 1:
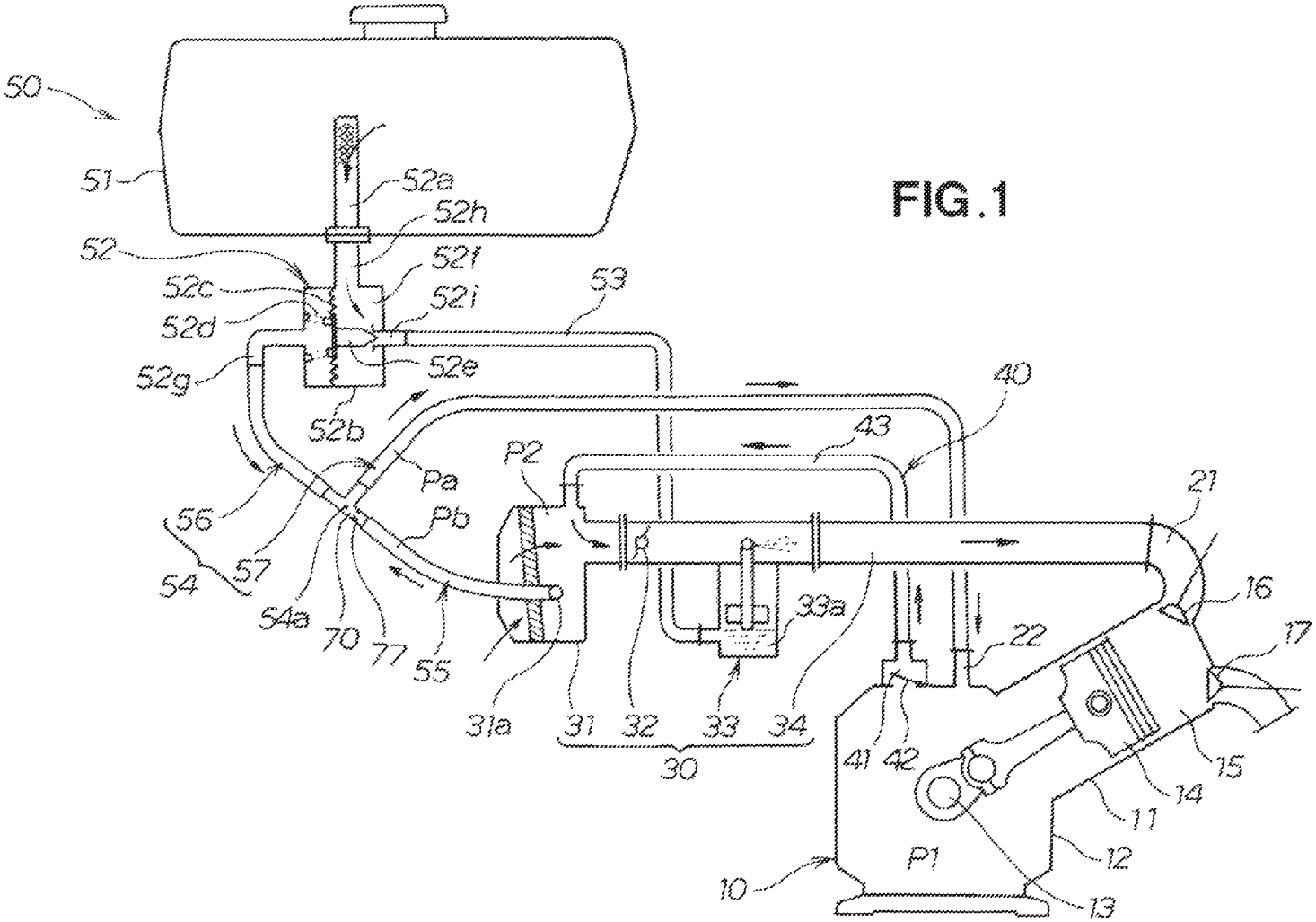
FIG. 1 is a schematic diagrammatical view showing an internal combustion engine that includes a fuel supplying apparatus according to an embodiment of the present invention.

An internal combustion engine 10 depicted in FIG. 1 includes, for example, a transverse single-cylinder four-cycle engine. The internal combustion engine 10 includes: a crankcase 12 that integrally has a cylinder 11, a crank shaft 13, a piston 14, a combustion chamber 15, an intake valve 16, and an exhaust valve 17. The crank shaft 13 is horizontally disposed. The cylinder 11 is inclined upward.

An intake system 30 for the internal combustion engine 10 includes an air cleaner 31, a throttle valve 32, a carburetor 33, and an intake pipe 34. The carburetor 33 has a float chamber 33*a* that temporarily retains fuel. The intake pipe 34 is connected to an intake inlet 21 of the internal combustion engine 10.

In the internal combustion engine 10, a portion of combustion gas produced in the combustion chamber 15 leaks from a point between the cylinder 11 and the piston 14 into the crankcase 12. The combustion gas leaking is referred to as "blowby gas". The blowby gas includes a large amount of oil mist and carbon hydrides (HC). To lubricate a sliding part that is accommodated in the crankcase 12, lubricating oil in the crankcase 12 is raked up upward to be splashed around and, thereby, oil mist can be produced in the crankcase 12. The blowby gas and the oil mist can not be released as they are into the atmosphere.

The internal combustion engine 10 of the embodiment includes a blowby gas reduction system 40 to circulate the blowby gas and the oil mist to the combustion chamber 15 through the intake system 30. The blowby gas reduction system 40 is configured by connecting the crankcase 12 to the air cleaner 31 through a breather chamber 41, a reed valve 42, and a breather path 43. The breather chamber 41 is formed in the top portion of the crankcase 12. The reed valve 42 is a one-way valve to open and close the breather path 43, is usually closed, and is opened only when a positive pressure is generated in the crankcase 12. The breather path 43 includes a hose and connects between the breather chamber 41 and the air cleaner 31.

During driving of the internal combustion engine 10, a large negative pressure and a micro positive pressure are alternately generated repeatedly in the crankcase 12 associated with the reciprocating motion of the piston 14. When the positive pressure is generated in the crankcase 12, the blowby gas and the oil mist produced in the crankcase 12 are returned to the air cleaner 31 and, thereby, are circulated to the intake system 30. Therefore, the blowby gas and the oil mist together with combustion air are supplied from the intake system 30 to the combustion chamber 15 and are again combusted.

Figure 2:
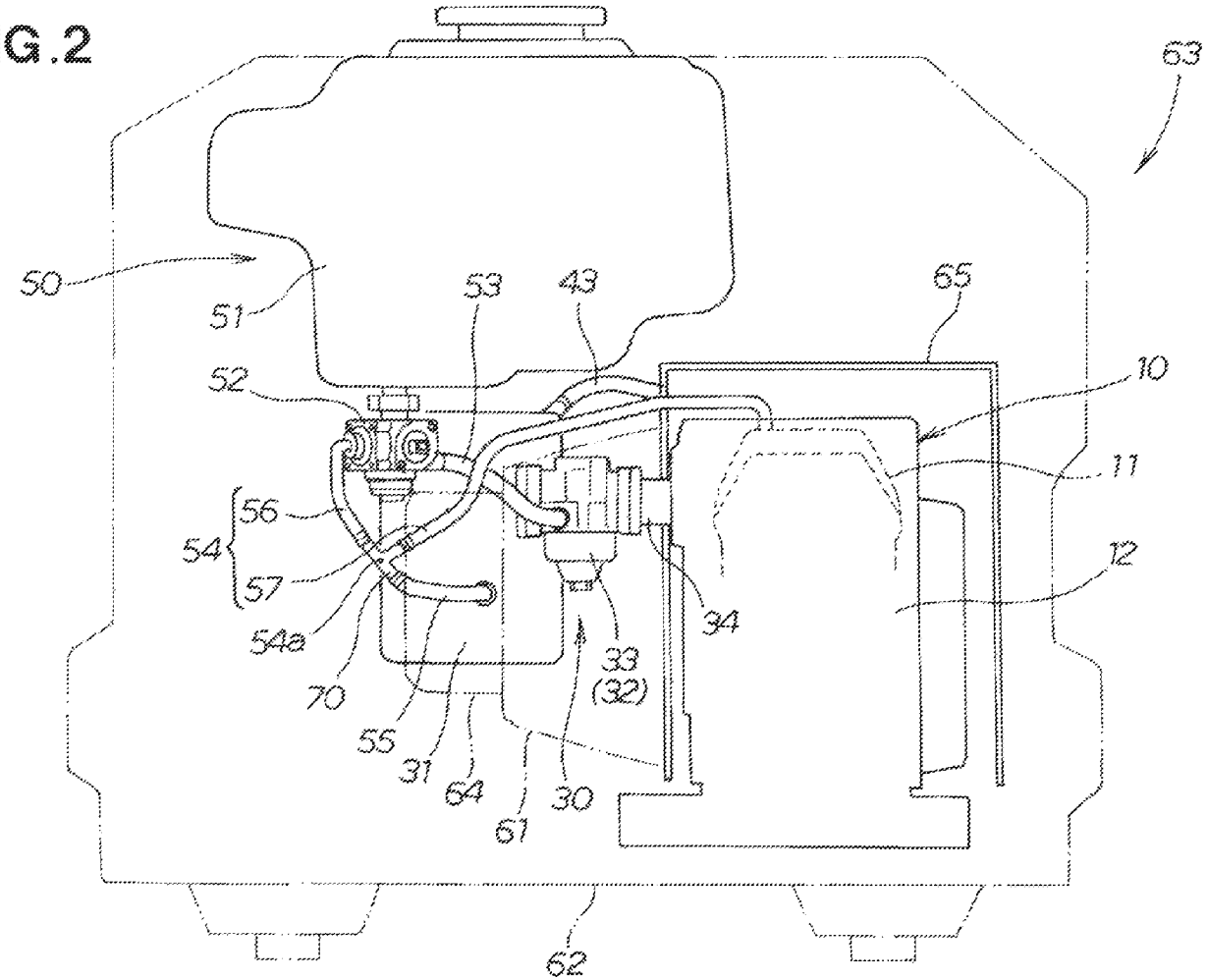
FIG. 2 is a side view of the internal combustion engine including the fuel supplying apparatus, shown in FIG. 1.

As depicted in FIGS. 1 and 2, a fuel supplying apparatus 50 for the internal combustion engine 10 employs a scheme of supplying fuel by using the gravity. The fuel supplying apparatus 50 includes a fuel tank 51, an automatic cock 52, a fuel supply path 53, and a negative pressure communication path 54. More specifically, the fuel supplying apparatus 50 has the fuel tank 51 that is disposed above the carburetor 33 and the fuel is supplied from the fuel tank 51 to the carburetor 33 (more specifically, the float chamber 33*a* of the carburetor 33).

As depicted in FIG. 1, the automatic cock 52 is a valve that automatically opens the fuel supply path 53 by using the negative pressure in the crankcase 12. The automatic cock 52 includes an oil filter 52*a*, a case 52*b*, a diaphragm 52*c*, a return spring 52*d*, and a valve body 52*e*. The oil filter 52*a* filters the fuel supplied from the fuel tank 51 and introduces the fuel into the case 52*b*. The case 52*b* accommodates the diaphragm 52*c*, the return spring 52*d*, and the valve body 52*e*. The diaphragm 52*c* is a valve driving body that, in a valve chamber 52*f* in the case 52*b*, drives the valve body 52*e*. In the ordinary state where no negative pressure acts on a negative pressure introducing inlet 52*g*, the return spring 52*d* biases the diaphragm 52*c* in a direction for the valve body 52*e* to be closed.

The case 52*b* includes the negative pressure introducing inlet 52*g*, a fuel inlet 52*h*, and a fuel outlet 52*i*. The negative pressure introducing inlet 52*g* is connected to a communication opening 22 of the crankcase 12 by the negative pressure communication path 54. This communication opening 22 is formed in the top portion of the crankcase 12. The fuel inlet 52*h* is connected to the fuel tank 51. The fuel outlet 52*i* is connected to the float chamber 33*a* by the fuel supply path 53. The fuel supply path 53 and the negative pressure communication path 54 are each configured by a hose. As depicted in FIGS. 2 to 5, the fuel supply path 53 is inclined downward from the fuel outlet 52*i* toward the float chamber 33*a*.

As depicted in FIG. 1, during the driving of the internal combustion engine 10, a large negative pressure and a micro positive pressure are alternately generated repeatedly in the crankcase 12 associated with the reciprocating motion of the piston 14. When a predetermined negative pressure set in advance acts from the crankcase 12 to the negative pressure introducing inlet 52*g*, the diaphragm 52*c* resists a biasing force of the return spring 52*d* and opens the valve body 52*e*. When the negative pressure is generated in the crankcase 12, the automatic cock 52 automatically opens due to the negative pressure. As a result, due to the gravity, the fuel in the fuel tank 51 passes through the oil filter 52*a*, the fuel inlet 52*h*, the valve chamber 52*f*, the fuel outlet 52*i*, and the fuel supply path 53 and is supplied to the float chamber 33*a*. The fuel supplied to the float chamber 33*a* is sprayed into the carburetor 33, is mixed with the combustion air, and, thereafter, is supplied to the intake inlet 21 of the internal combustion engine 10.

Figure 3:
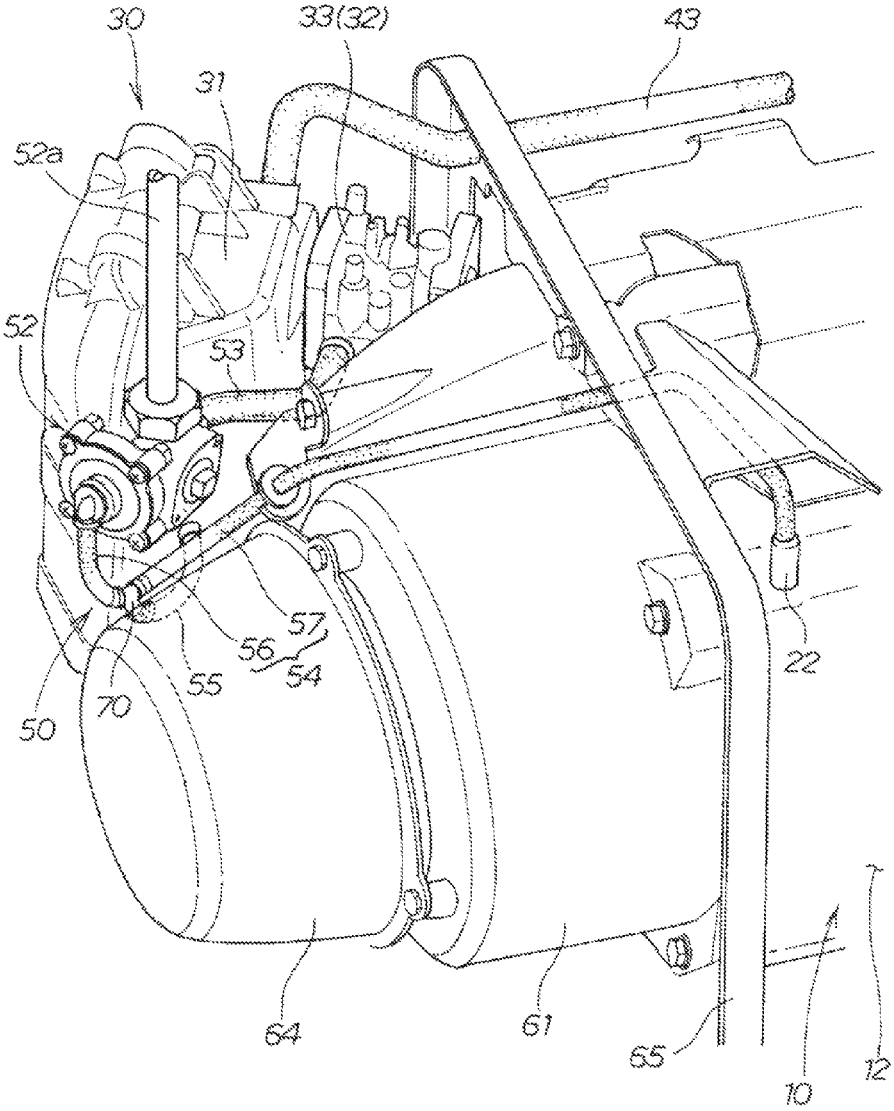
FIG. 3 is a perspective view showing a relation between the fuel supplying apparatus and the internal combustion engine of FIG. 2.
Figure 4:
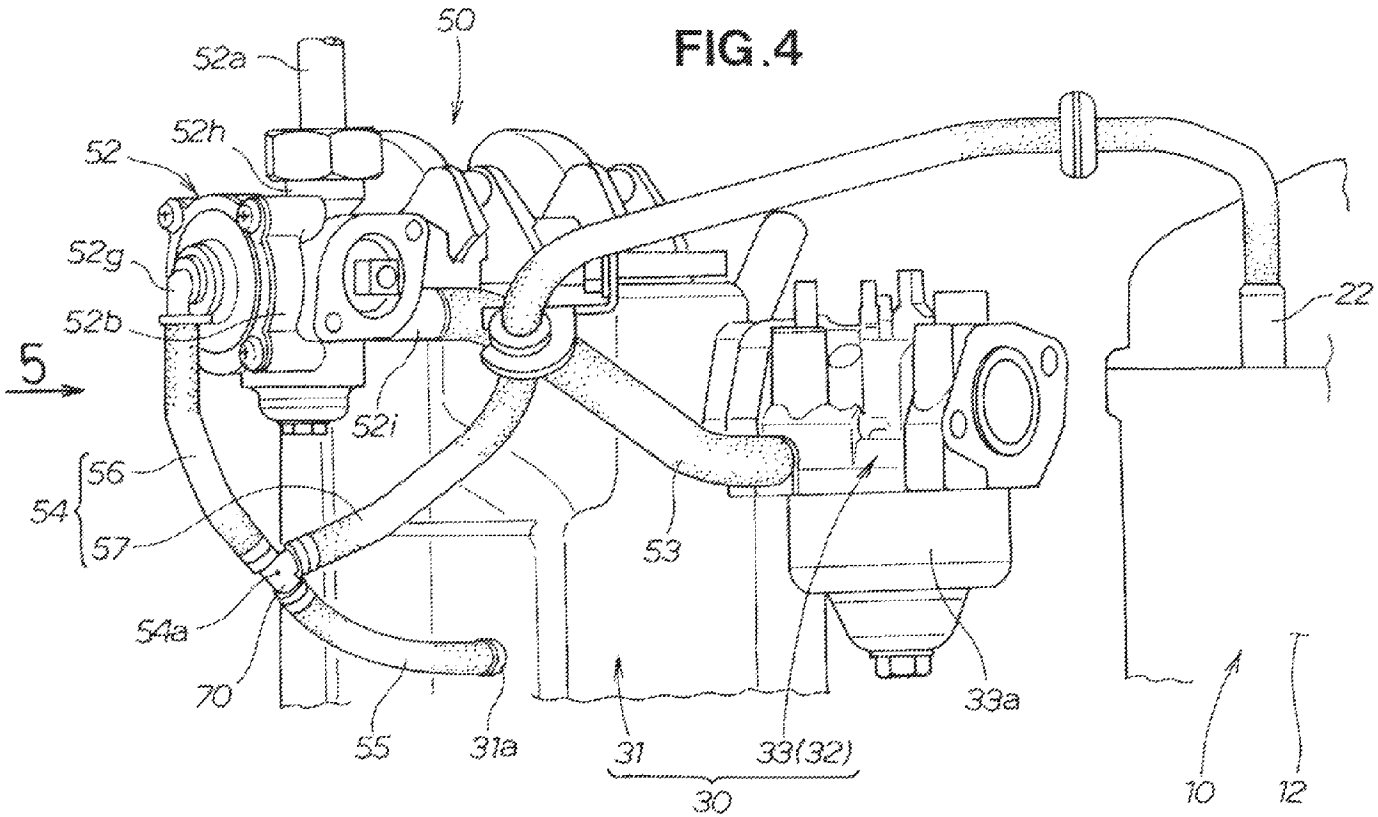
FIG. 4 is a side view showing a relation between an intake system and the fuel supplying apparatus of FIG. 2.
Figure 5:
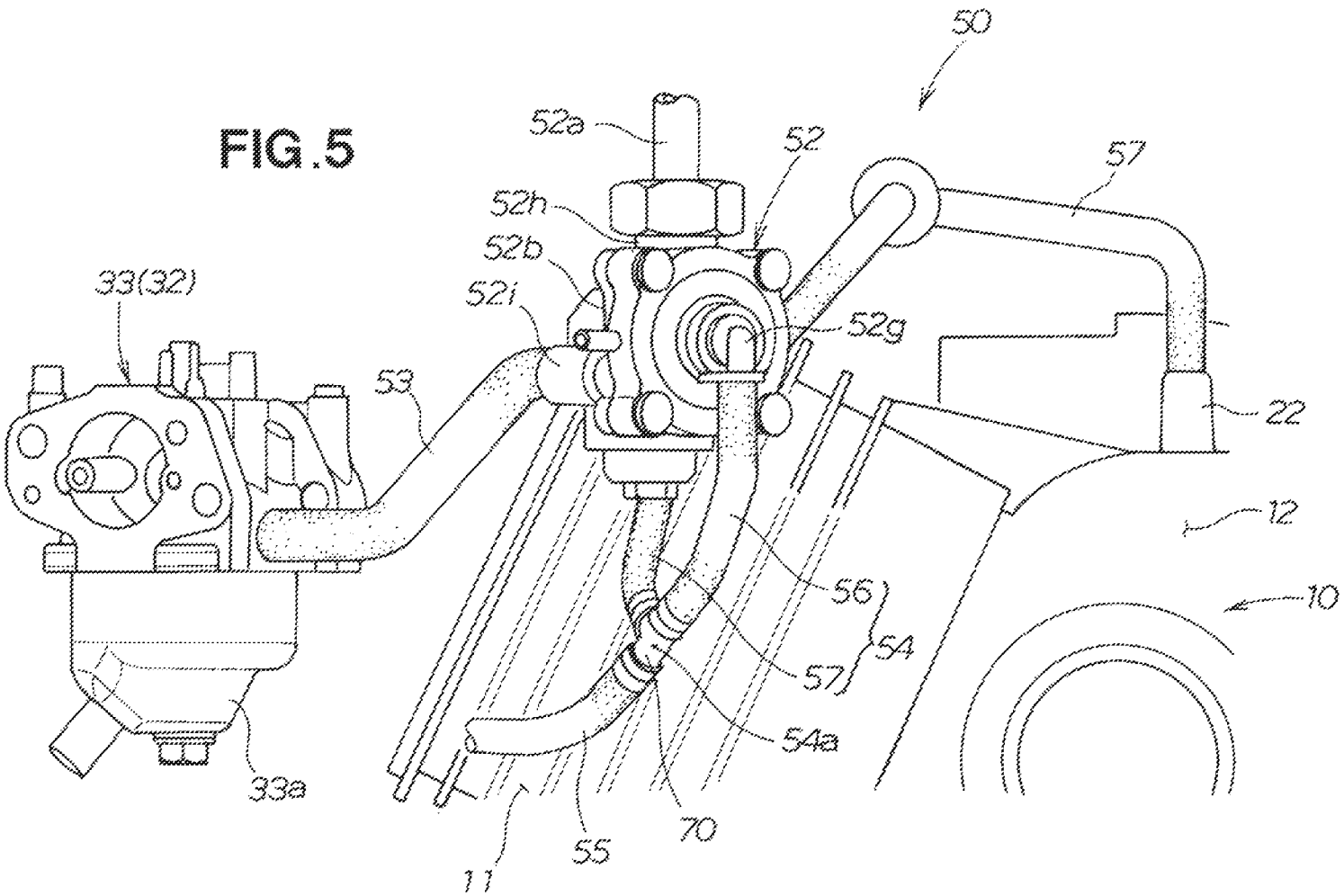
FIG. 5 is a diagrammatical view showing a relation among the internal combustion engine, a carburetor, and an automatic cock, as seen in the direction of arrow 5 of FIG. 4.

As depicted in FIGS. 2 and 3, the internal combustion engine 10 is incorporated in a frame 62 together with an electric generator 61, the fuel tank 51, and a muffler not depicted. A unit incorporated to be one in this manner is referred to as "electric generator unit 63". The internal combustion engine 10 has the electric generator 61 and a recoil starter 64 that are integrally incorporated in a side portion thereof. The electric generator 61 is directly coupled to the crank shaft 13 (FIG. 1) and, thereby, is driven by the internal combustion engine 10. The periphery of the internal combustion engine 10 is covered with a shielding cover 65.

As depicted in FIGS. 2 and 3, beside the internal combustion engine 10, the intake system 30 is positioned being placed beside the electric generator 61 and the recoil starter 64. The fuel tank 51 is positioned exactly above the intake system 30, that is, exactly above the air cleaner 31 and the carburetor 33. The automatic cock 52 is positioned exactly under the fuel tank 51 and is placed beside the top portion of the air cleaner 31. The automatic cock 52 is positioned in the vicinity of the air cleaner 31 and the recoil starter 64.

As depicted in FIGS. 2 to 5, the negative pressure communication path 54 including hoses is connected to the negative pressure introducing inlet 52*g* and the communication opening 22 in the state where the negative pressure communication path 54 is loose to take a substantially V-shape. Of the negative pressure communication path 54, a portion (connecting portion) 54*a* at the bottom thereof having a substantially V-shape, that is, the halfway point of the negative pressure communication path 54 is the lowest position of the negative pressure communication path 54. The portion 54*a* at the bottom having the V-shape is hereinafter referred to as "the lowest position 54*a* of the negative pressure communication path 54".

Describing with reference also to FIG. 1, the negative pressure communication path 54 communicates with a connection opening 31*a* of the air cleaner 31 through a purge path 55 that branches from the halfway point of the path (the lowest position 54*a* of the negative pressure communication path 54). The purge path 55 includes a hose. The point at which the purge path 55 branches from the negative pressure communication path 54 is positioned at the lowest position 54*a* of the negative pressure communication path 54. Therefore, the oil mist can be collected that intrudes from the crankcase 12. Hereinafter, the lowest position 54*a* of the negative pressure communication path 54 is referred to as "point 54*a* at which the purge path 55 branches from the negative pressure communication path 54" when suitable.

The point 31*a* at which the purge path 55 is connected to the air cleaner 31, that is, the connection opening 31*a* is located at a position that is lower than the branching point 54*a*. The shape presents a substantially Y-shape, that is formed by connecting the purge path 55 to the bottom of the negative pressure communication path 54 having the V-shape.

Figure 6:
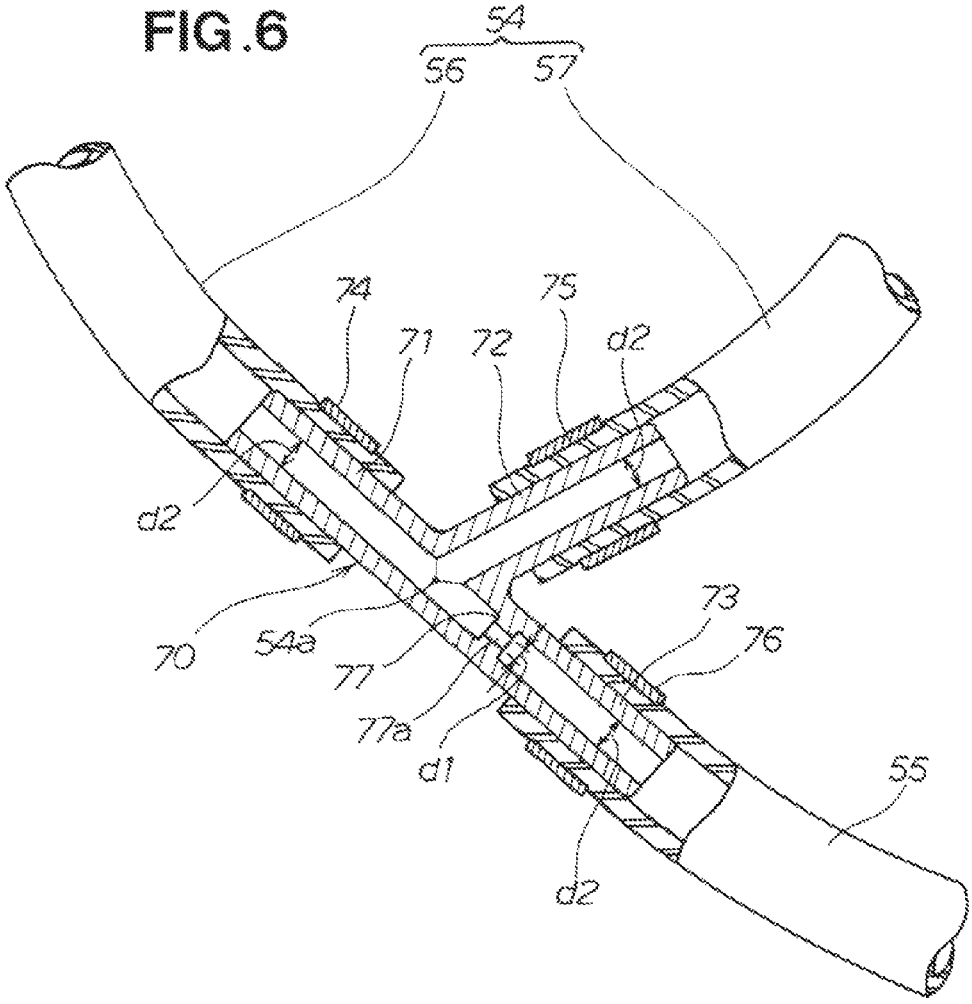
FIG. 6 is a side view showing, partially in section, a portion with a point at which a purge path branches from a negative pressure communication path of FIG. 4.

The configuration around the branching point 54*a* will be described in more detail. As depicted in FIGS. 1 and 6, the negative pressure communication path 54 is divided into two along the longitudinal direction of the hose at the lowest position 54*a* and these divided portions are connected to each other by a hose joint 70 having a T shape or a Y shape. The negative pressure communication path 54 includes a first communication path 56 that is connected to the negative pressure introducing inlet 52*g* of the automatic cock 52, and a second communication path 57 that is connected to the communication opening 22 of the crankcase 12.

As depicted in FIG. 6, the hose joint 70 is a kind of pipe joint to connect three hoses to each other in a substantially T shape or a substantially Y shape and integrally has a first, a second, and a third joint units 71, 72, and 73. Preferably, the internal angle formed by the first and the second joint units 71 and 72 is in a range of 100° to 120°. The third joint unit 73 extends in a direction therefor to be aligned on a substantially straight line with the first joint unit 71. The joint units 71 to 73 each are a male joint to be inserted into a hose.

The first joint unit 71 is inserted into an end of the first communication path 56 (first hose) and these components are clamped by a hose band 74. The second joint unit 72 is inserted into an end of the second communication path 57 (second hose) and these components are clamped by a hose band 75. The third joint unit 73 is inserted into an end of the purge path 55 (third hose) and these components are clamped by a hose band 76.

When the purge path 55 and the first and the second communication paths 56 and 57 are fitted to the hose joint 70, the third joint unit 73 is located at a position that is lower than those of the first and the second joint units 71 and 72. The branching point 54*a* of the first, the second, and the third joint units 71, 72, and 73 corresponds to the point 54*a* at which the purge path 55 branches from the negative pressure communication path 54.

The purge path 55 has an air flow resistance increasing unit 77 in the vicinity of the branching point 54*a*. The air flow resistance increasing unit 77 sets air flow resistance of the purge path 55 to be higher than that of the negative pressure communication path 54. More specifically, the air flow resistance increasing unit 77 includes, for example, an orifice plate that is positioned in the third joint unit 73 and in the vicinity of the branching point 54*a*. The orifice plate 77 (air flow resistance increasing unit 77) is a flat plate that intervenes in the piping path of the third joint unit 73, and has one small hole (orifice) 77*a* in the center thereof such that a differential pressure is generated between its upstream side and its downstream side. The diameter d1 of the small hole 77*a* is set to be smaller than the hole diameter d2 of each of the first, the second, and the third joint units 71 to 73.

An operation of the fuel supplying apparatus according to the embodiment will be described.

As depicted in FIG. 1, the embodiment uses a property that, during the driving of the internal combustion engine 10, a pressure P1 in the crankcase 12 is generally lower than a pressure P2 in the air cleaner 31. The pressure in the air cleaner 31 is higher than the pressure in the crankcase 12.

According to the embodiment, the purge path 55 branches from the negative pressure communication path 54 at the halfway point thereof and the purge path 55 communicates between the negative pressure communication path 54 and the air cleaner 31. Therefore, the air in the air cleaner 31 flows from the purge path 55 into the crankcase 12 passing through the negative pressure communication path 54. The intrusion of the oil mist into the negative pressure communication path 54 can be excluded by the air in the air cleaner 31. As a result, it is suppressed for the oil mist in the crankcase 12 to pass through the negative pressure communication path 54 and intrude into the negative pressure introducing inlet 52*g* of the automatic cock 52.

In addition, the point 54*a* at which the purge path 55 branches from the negative pressure communication path 54 is set to be at the lowest position of the negative pressure communication path 54 to be able to collect the oil mist that intrudes from the crankcase 12. Even when the oil mist intrudes from the crankcase 12 into the negative pressure communication path 54, the oil mist intruding gathers at the lowest position 54*a* of the negative pressure communication path 54. Therefore, even when the automatic cock 52 is not disposed above the crankcase 12, the intrusion can be suppressed of the oil mist into the negative pressure introducing inlet 52*g*. The automatic cock 52 does not need to be disposed above the crankcase 12 and, therefore, the positions of the automatic cock 52 and the fuel tank 51 can arbitrarily be set to be at positions at which no thermal influence is received that is caused by the heat dissipation from the internal combustion engine 10. Therefore, the degree of freedom of the disposition of the fuel supplying apparatus 50 can be increased.

Even when the height is limited for disposing the fuel tank 51, the capacity of the fuel tank 51 can sufficiently be secured by disposing the fuel tank 51 at a suitable position. For example, even when the internal combustion engine 10 and the fuel supplying apparatus 50 are incorporated as one unit and the height of the unit as a whole is limited, the capacity of the fuel tank 51 can sufficiently be secured by suitably setting the position of the fuel tank 51.

According to the embodiment, the point 31*a* at which the purge path 55 is connected to the air cleaner 31, that is, the connection opening 31*a* of the air cleaner 31 is located at the position that is lower than the branching point 54*a*. Therefore, the oil mist gathering at the lowest position 54*a* of the negative pressure communication path 54 enters the air cleaner 31 passing through the purge path 55 due to the gravity. The oil mist entering the air cleaner 31 is combusted in the combustion chamber 15. As a result, the intrusion of the oil mist into the negative pressure introducing inlet 52*g* can further be suppressed.

Furthermore, according to the embodiment, the purge path 55 has the air flow resistance increasing unit 77 and, therefore, the air flow resistance of the purge path 55 is larger than the air flow resistance of the negative pressure communication path 54. Therefore, the pressure difference does not become excessive between the internal pressure Pa of the negative pressure communication path 54 and the internal pressure Pb of the purge path 55. Because the pressure difference is proper, the negative pressure state in the negative pressure communication path 54 is not cancelled due to the pressure of the air that flows from the purge path 55 to the negative pressure communication path 54. Therefore, the negative pressure can be secured in the negative pressure communication path 54 to cause the automatic cock 52 to open and, therefore, the automatic cock 52 can suitably be caused to operate to open and close.

Yet furthermore, the purge path 55 is provided, in the vicinity of the point 54*a* at which the purge path 55 branches from the negative pressure communication path 54, with the air flow resistance increasing unit 77 to set the air flow resistance of the purge path 55 to be higher than the air flow resistance of the negative pressure communication path 54. The pressure loss of the purge path 55 as a whole is increased by increasing the air flow resistance of the purge path 55 by the air flow resistance increasing unit 77. As a result, at the branching point 54*a*, the pressure difference can be set to be an optimal value between the internal pressure Pa of the negative pressure communication path 54 and the internal pressure Pb of the purge path 55. Because the pressure difference is proper, the negative pressure state in the negative pressure communication path 54 is not offset by the pressure of the air that flows from the purge path 55 to the negative pressure communication path 54. The negative pressure in the negative pressure communication path 54 can sufficiently be secured that acts to open the automatic cock 52 and, therefore, the automatic cock 52 can suitably be operated to open and close.

The fuel supplying apparatus 50 of the present invention is suitable to be used in a configured article having the internal combustion engine 10 and the fuel tank 51 incorporated therein as one unit, for example, a small generator that is driven by an internal combustion engine.

Obviously, various minor changes and modifications of the present invention are possible in light of the above teaching It is therefore to be understood that within the scope of the appended claims the invention may be practiced otherwise than as specifically described.

What is claimed is:

1. A fuel supplying apparatus for an internal combustion engine, comprising:

a crankcase of the internal combustion engine;

a negative pressure introducing inlet of an automatic cock connected to the crankcase through a negative pressure communication path; and a fuel supplying path that is opened for supplying fuel from a fuel tank to the internal combustion engine, by opening the automatic cock via a negative pressure generated in the crankcase, wherein the negative pressure communication path communicates with an air cleaner through a purge path that branches from the negative pressure communication path at a halfway point of the negative pressure communication path, and a point at which the purge path branches from the negative pressure communication path is set to be at a lowest position of the negative pressure communication path so as to collect oil mist that intrudes from the crankcase.

2. The fuel supplying apparatus of claim 1, wherein a point at which the purge path is connected to the air cleaner is positioned at a position that is lower than the point at which the purge path branches.

3. The fuel supplying apparatus of claim 1, wherein the purge path has an air flow resistance increasing unit in a vicinity of the point at which the purge path branches, and the air flow resistance increasing unit is adapted to set air flow resistance of the purge path to be higher than air flow resistance of the negative pressure communication path.

* * * * *